United States Patent [19]

Larson

[11] 4,150,457

[45] Apr. 24, 1979

[54] TOOTHBRUSH

[76] Inventor: David F. Larson, N113 W13341 Crestview Dr., Germantown, Wis. 53022

[21] Appl. No.: 836,365

[22] Filed: Sep. 26, 1977

[51] Int. Cl.[2] ..... A46B 9/04

[52] U.S. Cl. ..... 15/106; 15/167 R

[58] Field of Search ..... 15/167 R, 110, 106, 15/143 R; D4/25–28, 18, 24

[56] References Cited

U.S. PATENT DOCUMENTS

| | | | |
|---|---|---|---|
| D. 139,264 | 10/1944 | Littig | D4/28 |
| D. 142,917 | 11/1945 | Strieby | D4/25 |
| 2,084,873 | 6/1937 | Strause | 15/167 R |
| 2,251,853 | 8/1941 | Pandiyan | D4/28 |
| 4,053,959 | 10/1977 | Wiley | 15/167 R |

FOREIGN PATENT DOCUMENTS

| | | | |
|---|---|---|---|
| 835142 | 9/1938 | France | 15/167 R |
| 881678 | 2/1943 | France | 15/167 R |
| 1390879 | 1/1965 | France | 15/167 R |
| 7789 of | 1886 | United Kingdom | D4/28 |
| 623575 | 5/1949 | United Kingdom | 15/167 R |

*Primary Examiner*—Peter Feldman

*Attorney, Agent, or Firm*—Michael, Best & Friedrich

[57] ABSTRACT

A toothbrush consisting of an integrally molded elongated handle including a generally cylindrical intermediate portion having a longitudinal axis, and two tapered curved neck portions extending from opposite ends thereof, each neck portion having a brush head secured thereto. The brush heads extend in substantially parallel planes, and at opposite angles with respect to the longitudinal axis and include bristle tufts secured thereto for forming a pair of circular convex substantially identical bristle surfaces so that one of the bristle surfaces extends inwardly toward the handle and the other one of the bristle surfaces extends outwardly away from the handle, whereby the brush heads can be effectively utilized to remove plaque from the concave surfaces of all of the user's teeth and gums.

10 Claims, 10 Drawing Figures

TOOTHBRUSH

BACKGROUND OF THE INVENTION

I. Field of the Invention

The invention relates generally to toothbrushes, and more particularly, to toothbrushes having two brush heads arranged to provide for more efficient cleaning of the user's teeth and gums.

II. Description of the Prior Art

Various prior art toothbrushes have been proposed to provide for more efficient cleaning of the user's teeth and gums. Typical and pertinent examples of such toothbrushes, including examples of toothbrushes having two brush heads, are included in the following U.S. Pat. Nos.:

Levin 1,913,990 issued June 13, 1933
Fitzgerald 2,153,554 issued Apr. 11, 1939
Meeske 2,229,664 issued Jan. 28, 1941
Seko 2,651,068 issued Sept. 8, 1953
Gracian 2,978,724 issued Apr. 11, 1961
Soleymani 3,474,481 issued Oct. 28, 1969

Despite the design of numerous prior art toothbrushes which have attempted to provide for more efficient cleaning of the user's teeth, there still exists the problem of inadequate removal of plaque from the concave surfaces of at least some of the user's teeth. Such inadequate removal of plaque results in tooth decay, and gum or periodontal disease. The incidence of such tooth decay and gum disease is found by dentists to be widely prevalent, notwithstanding the fact that at least some of the unfortunate patients do regularly brush with conventionally designed or standard design toothbrushes available today.

While various prior art toothbrush designs have been proposed, the "standard design" toothbrush which has evolved basically consists of a brush with a straight handle having a brush head with bristles set in a rectangular configuration. Prior art toothbrushes and such standard design toothbrushes do not lend themselves effectively to cleaning the lingual surfaces of the anterior teeth because the generally long flat arrangement of the rectangular bristle configuration will not fit into the curved areas directly behind the anterior teeth, either on the top or bottom of the user's mouth. The present day manufacturers' attempt to overcome this inadequacy by advising the users to place the "toe" or outer edge of the brush into these areas to clean them. This requires a very difficult and clumsy maneuver by the patient and as a result the areas are not cleaned.

As a result of inadequate cleaning, calculus or tartar is generally formed in the concave region behind the six lower front teeth. This area always contains a pool of saliva and the calcium and phosphorus in the saliva precipitates out into the old plaque which is left on the teeth in this area (old plaque refers to plaque which has remained on the teeth for some period of time in excess of 24 hours and has become more firmly affixed to the teeth). When this precipitation occurs calculus forms, and it provides a porous surface for new plaque to attach to. A fresh layer of plaque becomes active here, producing acids and irritants to cause decay and gum disease, respectively.

Soon this plaque becomes calculus and another layer of plaque forms, on and on until the teeth are firmly entrenched in a covering of calculus. This results in local infection and irritation of the attachment apparatus or ligaments of the teeth, and periodontal disease sets in. All this occurs while the patient may be brushing the front surfaces of the teeth fairly adequately, but the damage goes on undetected on the lingual or concave back surface of the lower front teeth.

Another problem area is the back or lingual portion of the upper anterior or front teeth. This area is located and curved in such a way as to make the use of a prior art or standard toothbrush very difficult. The straight line rectangular bristle configuration of a standard toothbrush makes cleaning the lingual concave surfaces of these teeth almost impossible and the gum line area even more difficult. The patient cannot see this surface of the teeth and if they are to try, as the general advice from most brush manufacturers goes, to use the "toe" of the brush, their effectiveness here is strictly and severely limited.

In summary, despite the design of numerous prior art toothbrushes which have attempted to provide for more efficient cleaning of the user's teeth, such prior art toothbrushes have been found to be lacking in providing a toothbrush which can be used for removing plaque from all of the user's teeth. Specifically, such prior art toothbrushes have not provided the user with two brush heads having convex bristle surfaces which are designed and arranged to be comfortable, and which are easy to selectively use for efficiently removing plaque which forms on the concave lingual surfaces of the upper and lower teeth, and on the concave surfaces of all of the user's other teeth.

This invention is concerned with this general area and has among its objects to provide a toothbrush which avoids some or all of the inadequacies of the prior art.

Another more particular object of the present invention is to provide a toothbrush which is simple and economical to manufacture, and which is designed to cooperate with the user's hand, mouth and teeth so as to be comfortable and easy to use, while still providing for efficient removal of plaque from the user's teeth, thus insuring its more regular and thorough use.

A still more particular object of the present invention is to provide such a toothbrush which includes two brush heads having convex bristle surfaces designed and arranged so that plaque can be efficiently removed from the lingual and other concave surfaces of all of the user's teeth and gums.

SUMMARY OF THE INVENTION

To achieve the foregoing objects, the invention provides a toothbrush comprising an elongated handle including an intermediate portion having a longitudinal axis, and a pair of brush heads extending in substantially parallel planes, and respectively secured to opposite ends of the handle, the brush heads including bristle tufts respectively secured thereto for forming a pair of substantially identical bristle surfaces. Each of the brush heads extends at an angle with respect to the longitudinal axis so that one of the bristle surfaces generally extends inwardly toward the intermediate portion of the handle and the other one of the bristle surfaces generally extends outwardly away from the intermediate portion of the handle, whereby the brush heads can be effectively utilized to remove plaque from the concave surfaces of all of the user's teeth.

The handle and brush heads are preferably integrally molded in one piece. Each of the brush heads is preferably disc-shaped and includes a rounded peripheral surface extending between front and back surfaces, the front and back surfaces of each of the brush heads extending in substantially parallel planes. To facilitate ease of molding and manufacture, each of the front surfaces of the brush heads is generally planar and is preferably molded to include holes which extend inwardly and generally perpendicularly with respect to the front surface. Each brush head preferably includes bristle tufts which are secured within the holes and which gradually increase in length from a minimum at the periphery of the front surface to a maximum at the center of the front surface so that the bristle tufts form a pair of generally circular convex bristle surfaces.

In the preferred construction, the integrally molded handle includes two tapered curved neck portions respectively extending from opposite ends of the intermediate portion and at generally opposite angels with respect to the longitudinal axis. Each of the brush heads is secured to one of the neck portions so that the brush heads extend at opposite angles of between 20 and 30 degrees with respect to the longitudinal axis. Both of the convex bristle surfaces extend outwardly in generally the same direction on the same side of the handle so that the back surface of the brush head not in immediate use can be utilized to support a portion of the user's hand. The intermediate portion of the handle preferably has a elongated generally cylindrical shape and includes a fluted outer surface to facilitate flexible and comfortable use of the toothbrush.

Other features and advantages of the embodiments of the invention will become known by reference to the following general description, the appended claims and the drawings.

GENERAL DESCRIPTION OF THE PREFERRED EMBODIMENT

Figure 1:
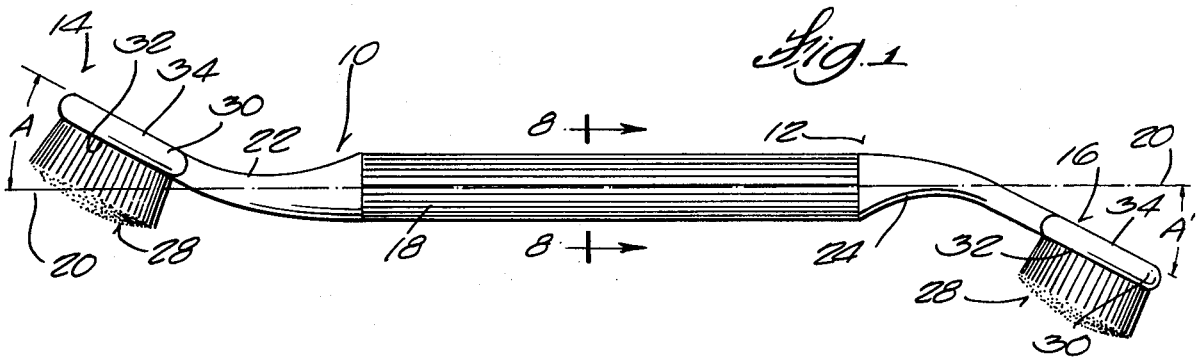
FIG. 1 is a side plan view of the toothbrush embodying various features of the invention.
Figure 2:
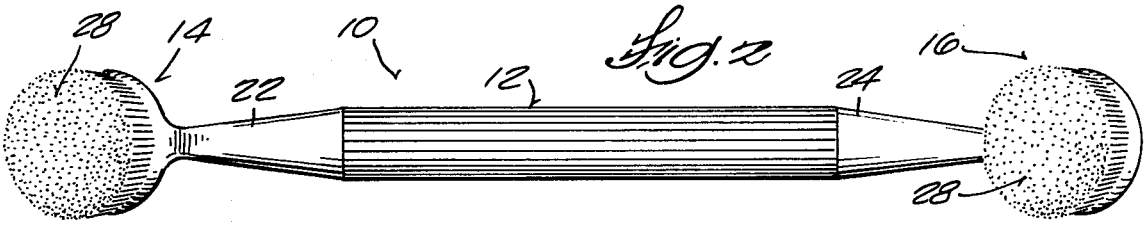
FIG. 2 is a front plan view of the toothbrush shown in FIG. 1.

Referring more particularly to the drawings, wherein like numerals refer to like parts throughout the several views, FIG. 1 shows a toothbrush 10 including an elongated handle, generally designated 12, and brush heads 14 and 16 secured at opposite ends thereto. The handle 12 preferably consists of an intermediate portion 18 having a longitudinal axis, designated 20, and includes two curved neck portions, 22 and 24 respectively, extending from opposite ends of the intermediate portion 18.

Each of the brush heads 14 and 16 include bristle tufts 26 forming substantially identical generally circular convex bristle surfaces 28 (described in more detail below) and are respectively secured to the neck portions 22 and 24 so that one of the convex bristle surfaces 28 extends generally inwardly toward the intermediate portion 18 of the handle, and the other one of the convex bristle surfaces 28 extends generally outwardly away from the intermediate portion 18 of the handle, whereby the brush heads can be effectively utilized to remove plaque from the concave surfaces of the user's teeth and gums.

Figure 9:
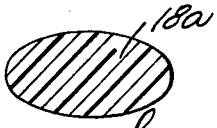
FIG. 9 is a sectional view similar to FIG. 8, illustrating an alternative embodiment wherein the intermediate portion of the handle has a different cross-sectional configuration.
Figure 8:
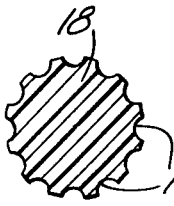
FIG. 8 is a sectional view of the intermediate portion of the handle of the toothbrush taken along line 8—8 shown in FIG. 1.

As shown in the illustrated construction, (See FIGS. 1 and 8) the intermediate portion 18 preferably has an elongated cylindrical shape and includes a fluted outer surface 19 to facilitate the user holding and maneuvering the toothbrush. If desired, the intermediate portion can have other cross-sectional configurations, such as the "football-shaped" configuration shown in FIG. 9, and which tends to orientate the brush in an advantageous and stable position in the user's hand. While other arrangements are possible, the two curved neck portions 22 and 24 preferably extend at generally opposite angles with respect to the longitudinal axis 20. Brush heads 14 and 16 are respectively secured to the curved neck portions 22 and 24 and also extend at opposite angles, designated A and A', with respect to longitudinal axis 22.

In order to provide easy access to, and efficient cleaning of the user's teeth, the brush heads 14 and 16 preferably extend at opposite angles of between 20 and 30 degrees with respect to the longitudinal axis 22. Opposite angles, A and A', of 23 degrees are believed to result in the most efficient configuration of the toothbrush for cleaning the user's teeth.

Each of the brush heads 14 and 16 is generally disc-shaped and includes a rounded outer peripheral surface 30 extending between the front surface 32 and the back surface 34, the front and back surfaces of each of the brush heads extending in substantially parallel planes so that one or the other of the brush heads can be maneuvered easily by the user to be in the same relative position with respect to all the surface areas of the user's teeth and gums. The bristle tufts 26 each preferably consist of about 30 individual round end nylon bristles, and are secured to the front surfaces 32 of the bristle heads to form a pair of substantially identical generally circular convex bristle surfaces 28, the feature of the substantially identical bristle surfaces being provided so that the user can easily orient one brush head or the other so that essentially the same optimum bristle surface can be applied to all the areas of the user's teeth and gums.

Figure 10:
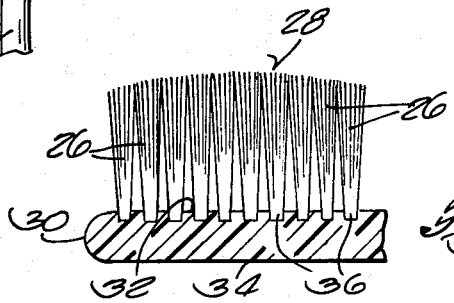
FIG. 10 is an enlarged sectional view of one of the brush heads of the toothbrush shown in FIG. 1.

The handle 12 and brush heads 14 and 16 are preferably integrally molded as one piece. In order to facilitate ease of molding and manufacture, each of the front surfaces (i.e. the surfaces of the brush heads to which the bristle tufts are secured) is generally planar and includes or is molded to form holes 36 which extend inwardly and generally perpendicularly with respect to the front surface. The bristle tufts 26 are secured within the holes 36 in a conventional manner and extend outwardly and generally perpendicularly with respect to the front surface. The bristle tufts can be uniformly secured within the holes 36 and can be selected to gradually increase in length from a minimum length (e.g. 9 mm.) at the periphery of the front surface to a maximum length (e.g. 11 mm.) at the center of the front surface (see FIG. 10) in order to provide the generally circular convex bristle surfaces 28.

USE OF THE TOOTHBRUSH

The toothbrush disclosed herein is designed to cooperate with the hand, mouth, and teeth of the user so as to be comfortable and easy to use while providing for efficient cleaning or removal of plaque from the user's teeth and gums, thus promoting its more regular and thorough use. In this regard, it should be noted that the bristle tufts 26 are respectively secured to the front surfaces 32 of the brush heads so that the generally circular convex bristle surfaces 28 extend outwardly in generally the same direction on the same side of the handle. Consequently, the toothbrush can be comfortably held so as to allow use of either brush head, i.e. the user's hand can be rested on, or supported by the back surface 34 of the brush head not in immediate use.

Figure 3:
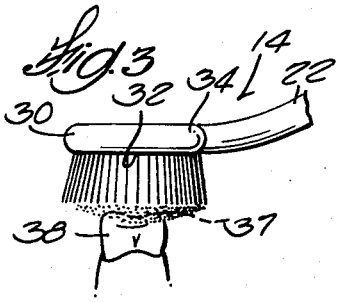
FIG. 3 is a partial view showing one of the brush heads in a position of contemplated use.
Figure 4:
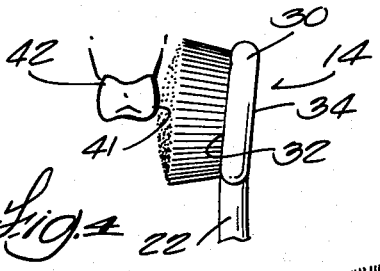
FIG. 4 is a partial view showing the brush head of FIG. 3 in another position of contemplated use.

Since the circular bristle surfaces 28 are respectively secured to brush heads which extend at opposite angles with respect to the longitudinal axis of the intermediate portion of the handle, the toothbrush can be comfortably and efficiently utilized for removing plaque which forms on the concave surfaces of all of the user's teeth and gums. More particularly, as shown in FIG. 3, for example, the brush head 14 which extends or curves generally outwardly away from the intermediate portion of the handle is particularly suited for cleaning the concave occlusal surface 37 of a lower molar 38. As shown in FIG. 4, brush head 14 is also particularly suited for cleaning the palatal surface 41 of the upper molar 42.

Figure 6:
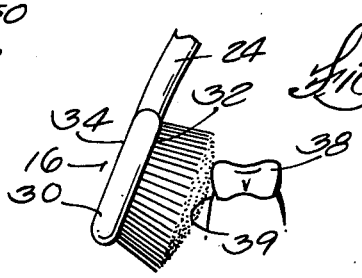
FIG. 6 is a partial view showing the other one of the brush heads in a position of contemplated use.

As shown in FIG. 6, the other brush head 16, which extends or curves generally inwardly toward the intermediate portion of the handle, is particularly suited for cleaning the lingual surface 39 of the lower molar 38. When FIG. 6 is inverted, it illustrates that the brush head 16 can also be used for cleaning the buccal surface of upper molars.

Figure 5:
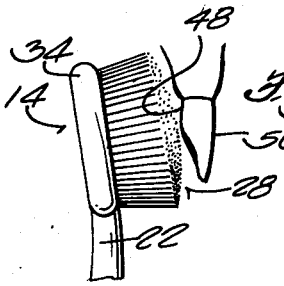
FIG. 5 is a partial view showing the brush head of FIG. 3 in yet another position of contemplated use.
Figure 7:
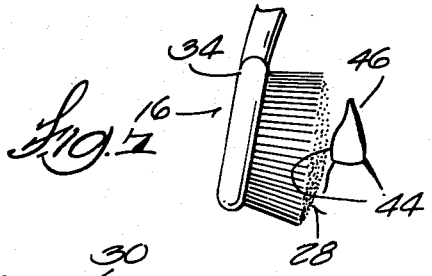
FIG. 7 is a partial view showing the brush head of FIG. 6 in another postion of contemplated use.

The curved neck portions and brush heads including the generally circular convex bristle surfaces are designed to effectively clean the lingual surfaces of upper and lower teeth. As illustrated in FIG. 7, brush head 16 would be particularly advantageous for cleaning the area behind and back of the lower front teeth, designated 44, i.e. the lingual surface of the lower anterior teeth 46 (one shown). Similarly, the brush head 14 (see FIG. 5) would be well-suited for cleaning the back of the upper front teeth, designated 48, i.e. the lingual surface of the upper anterior teeth 50 (one shown). As noted in the earlier Description of the Prior Art, both of these areas of the mouth are curved or concave and prior art toothbrushes have not cleaned these areas properly or comfortably, whereas my toothbrush with brush heads 14 and 16 will. Furthermore, since the convex bristle surfaces are generally circular, they are much less likely to cause toothbrush abrasion of the teeth and gums as is often caused by prior art or standard toothbrushes having rectangular bristle surface designs.

Thus, it should now be readily apparent that all the surfaces of the user's teeth and gums, and in particular the convex surfaces where plaque is likely to be formed, can be efficiently cleaned by using one or the other of the brush heads 14 and 16 of my toothbrush.

Since the brush heads 14 and 16 are generally disc-shaped and include rounded outer surfaces 30, the toothbrush can be used without causing injury or irritation to the user's mouth and gums. Also, since the bristle tufts adjacent the center of the front surface are longer, and hence inherently more flexible, the central bristle tufts can be utilized to reach deeper into the convex surfaces and areas formed between the user's teeth, and teeth and gum line. The shorter, and hence, inherently more rigid bristle tufts 26 extending around the periphery of the front surface tend to support and retain in position the longer and more flexible central bristle tufts. Also, the shorter bristle tufts themselves tend to resist becoming bent or deformed, thereby further insuring that the circular generally convex surface of the bristle tufts is retained.

It is to be understood that the invention is not confined to the particular construction and arrangement of parts herein illustrated and described, but is intended to embrace all such modified forms thereof which come within the scope of the following claims.

I claim:

1. A toothbrush comprising;

an elongated handle including an intermediate portion having a longitudinal axis, and a pair of brush heads respectively secured to opposite ends of said handle, said brush heads extending in substantially parallel planes and including bristle tufts respectively secured thereto for forming a pair of substantially identical bristle surfaces, each of said brush heads extending at an angle with respect to said longitudinal axis so that one of said bristle surfaces generally extends inwardly towards said intermediate portion of said handle and the other one of said bristles surfaces generally extends outwardly away from said intermediate portion of said handle, whereby said brush heads can be effectively utilized to remove plaque from all the surfaces of all the user's teeth and gums.

2. A toothbrush as specified in claim 1 wherein each of said brush heads is generally disc-shaped and includes a rounded peripheral surface extending between front and back surfaces, wherein each of said front surfaces of said brush heads is generally planar and include holes which extend inwardly and generally perpendicularly with respect to said front surface, and wherein said bristle tufts are secured within said holes and extend outwardly and generally perpendicularly with respect to said front surface, said bristle tufts gradually increasing in length from a minimum length at the periphery of said front surface to a maximum length at the center of said front surface so that said bristle tufts form a generally circular convex bristle surface.

3. A toothbrush as specified in claim 2 wherein said handle includes two curved neck portions respectively extending from opposite ends of said intermediate portion and at generally opposite angles with respect to said longitudinal axis, wherein each of said brush heads is respectively secured to one of said curved neck portions so that said brush heads extend at opposite angles with respect to said longitudinal axis, and wherein said bristle tufts are secured to said brush heads so that both of said convex bristle surfaces extend outwardly in generally the same direction on the same side of said handle.

4. A toothbrush as specified in claim 3 wherein said brush heads secured to said curved neck portions extend at opposite angles of between 20 to 30 degrees with respect to said longitudinal axis.

5. A toothbrush as specified in claim 3 wherein said intermediate portion of said handle has a generally elongated shape with a generally football-shaped cross-section.

6. A toothbrush as specified in claim 3 wherein each of said brush heads is secured to one of said curved neck portions so that said brush heads extend at opposite angles of 23° with respect to said longitudinal axis.

7. A toothbrush comprising an elongated handle including an intermediate portion having a longitudinal axis and two curved neck portions respectively extending from opposite ends of said intermediate portions and at angles with respect to said longitudinal axis, a pair of brush heads each respectively secured to one of said curved neck portions, each of said brush heads being generally disc-shaped and including a rounded peripheral surface extending between front and back surfaces, each of the front and back surfaces of each of said brush heads extending in substantially parallel planes and including bristle tufts secured to said front surface of said brush head for forming a pair of substantially identical bristle surfaces, each of said brush heads being secured to one of said curved neck portions and extending at an angle with respect to said longitudinal axis so that one of said bristle surfaces extends inwardly toward said intermediate portion of said handle and the other one of said bristle surfaces extends outwardly away from said intermediate portion of said handle, whereby said brush heads can be effectively utilized to remove plaque from all the surfaces of all of the user's teeth and gums.

8. A toothbrush as specified in claim 7 wherein said intermediate portion, said curved neck portions, and said brush heads are intergrally molded as one piece, wherein each of said front surfaces of said brush heads is generally planar and includes molded holes which extend inwardly and generally perpendicularly with respect to said front surface, and wherein said bristle tufts are secured within said holes and extend outwardly and generally perpendicularly with respect to said front surface, said bristle tufts gradually increasing in length from a minimum length at the periphery of said front surface to a maximum length at the center of said front surface so that said bristle tufts form a generally circular convex bristle surface.

9. A toothbrush as specified in claim 7 wherein said two curved neck portions respectively extend from opposite ends of said intermediate portion and at generally opposite angles with respect to said longitudinal axis, wherein each of said brush heads is secured to one of said curved neck portions so that said brush heads are held at opposite angles of between 20 and 30 degrees with respect to said longitudinal axis, and wherein said bristle tufts are respectively secured to said front surfaces of said brush heads so that said generally circular convex bristle surfaces extend outwardly in generally the same directions on the same side of said handle, whereby said back surface of the brush head not in immediate use can be utilized to support a portion of the user's hand.

10. A toothbrush comprising an integrally molded handle including an elongated generally cylindrical intermediate portion having a longitudinal axis, two tapered curved neck portions respectively extending from opposite ends of said intermediate portion and at generally opposite angles with respect to said longitudinal axis, and a pair of generally disc-shaped brush heads, each respectively secured to one of said neck portions and including a rounded peripheral surface extending between front and back surfaces, each of said front surfaces of said brush heads being generally planar and including holes which extend inwardly and generally perpendicularly with respect to said front surface, each of the front and back surfaces of each of the brush heads extending in substantially parallel planes, each of said brush heads including bristle tufts which are secured within said holes and extend outwardly and generally perpendicularly with respect to said front surface, said bristle tufts gradually increasing in length from a minimum length at the periphery of said front surface to a maximum length at the center of said front surface so that said bristle tufts form a pair of substantially identical, generally circular convex bristle surfaces, said generally circular convex bristle surfaces extending outwardly in generally the same direction on the same side of said handle so that the back surface of the brush head not in immediate use can be utilized to support a portion of the user's hand, and wherein each of said brush heads is secured to one of said curved neck portions so that said brush heads extend at opposite angles of between 20 and 30 degrees with respect to said longitudinal axis, each of said brush heads extending at an angle with respect to said longitudinal axis so that one of said convex bristle surfaces extends generally inwardly toward said intermediate portion of said handle and the other one of said convex bristle surfaces extends generally outwardly away from said intermediate portion of said handle, whereby said brush heads can be effectively utilized to remove plaque from all the surfaces of all of the user's teeth and gums.

* * * * *